US010979815B2

(12) United States Patent
Liu et al.

(10) Patent No.: US 10,979,815 B2
(45) Date of Patent: Apr. 13, 2021

(54) SPEAKER

(71) Applicant: AAC Technologies Pte. Ltd., Singapore (SG)

(72) Inventors: Xiaodong Liu, Shenzhen (CN); Long Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/706,738

(22) Filed: Dec. 7, 2019

(65) Prior Publication Data

US 2020/0213747 A1 Jul. 2, 2020

(30) Foreign Application Priority Data

Dec. 29, 2018 (CN) ..... 201822278997.3

(51) Int. Cl.
*H04R 9/02* (2006.01)
*H04R 9/04* (2006.01)
*H04R 7/04* (2006.01)

(52) U.S. Cl.
CPC ..... *H04R 9/025* (2013.01); *H04R 7/04* (2013.01); *H04R 9/045* (2013.01); *H04R 2400/11* (2013.01)

(58) Field of Classification Search
CPC ..... H04R 9/025; H04R 9/027
USPC ..... 381/412, 421
See application file for complete search history.

(56) References Cited

U.S. PATENT DOCUMENTS 8,270,661 B2 * 9/2012 Sorensen ..... H04R 9/063 381/421
8,660,292 B2 * 2/2014 Li ..... H02K 33/16 381/412
8,774,430 B2 * 7/2014 Heed ..... H02K 3/26 381/182
2015/0365768 A1 * 12/2015 Andersen ..... H04R 9/046 381/421

* cited by examiner

*Primary Examiner* — Suhan Ni
(74) *Attorney, Agent, or Firm* — W&G Law Group LLP

(57) ABSTRACT

The present invention relates to a speaker having a frame, a magnetic circuit system and a vibrating system. The magnetic circuit system has a main magnet and an auxiliary magnet. The vibrating system has a vibrating diaphragm, a voice coil and a suspension with a first avoiding space. The auxiliary magnet is surrounding the main magnet and passed through the first avoiding space. The first avoiding space is positioned in the suspension so that the auxiliary magnet can be arranged around the main magnet, thereby enhancing the strength of the magnetic field of the magnetic circuit system, and ensuring uniform force on the vibrating diaphragm for improving BLX symmetry of the vibrating diaphragm.

7 Claims, 2 Drawing Sheets

SPEAKER

FIELD OF THE PRESENT INVENTION

The present invention relates to the field of electro acoustic conversion, and more particularly to a magnetic circuit system of a speaker.

DESCRIPTION OF RELATED ART

With the advent of the mobile Internet era, the number of smart mobile devices is continuously increasing. Among numerous mobile devices, mobile phones are undoubtedly the most common and portable mobile terminal devices. At present, mobile phones have diverse functions, one of which is a high-quality music function. Therefore, speakers for playing sound are widely applied to current smart mobile devices.

In the related art, a speaker comprises a magnetic circuit system and a vibrating system. The magnetic circuit system includes a yoke, a main magnet arranged on the yoke, and an auxiliary magnet surrounding the main magnet. The vibrating system includes a vibrating diaphragm and a voice coil for driving the vibrating diaphragm to produce sounds. The speaker further has a suspension firmly fixed under the voice coil in order to improve the vibration performance of the vibrating system. However, once the suspension is arranged, the auxiliary magnet can't be positioned in the two ends of the main magnet near the suspension, thus the magnetic field of the magnetic circuit system is weakened, thereby resulting in uneven force on the vibrating diaphragm.

Therefore, it is desired to provide a new speaker which can overcome the above-mentioned problems.

DETAILED DESCRIPTION OF THE EXEMPLARY EMBODIMENT

The present invention will hereinafter be further described in detail with reference to the drawings and embodiments. The following examples are intended to illustrate the present invention, but not to limit the scope of the present invention.

Figure 1:
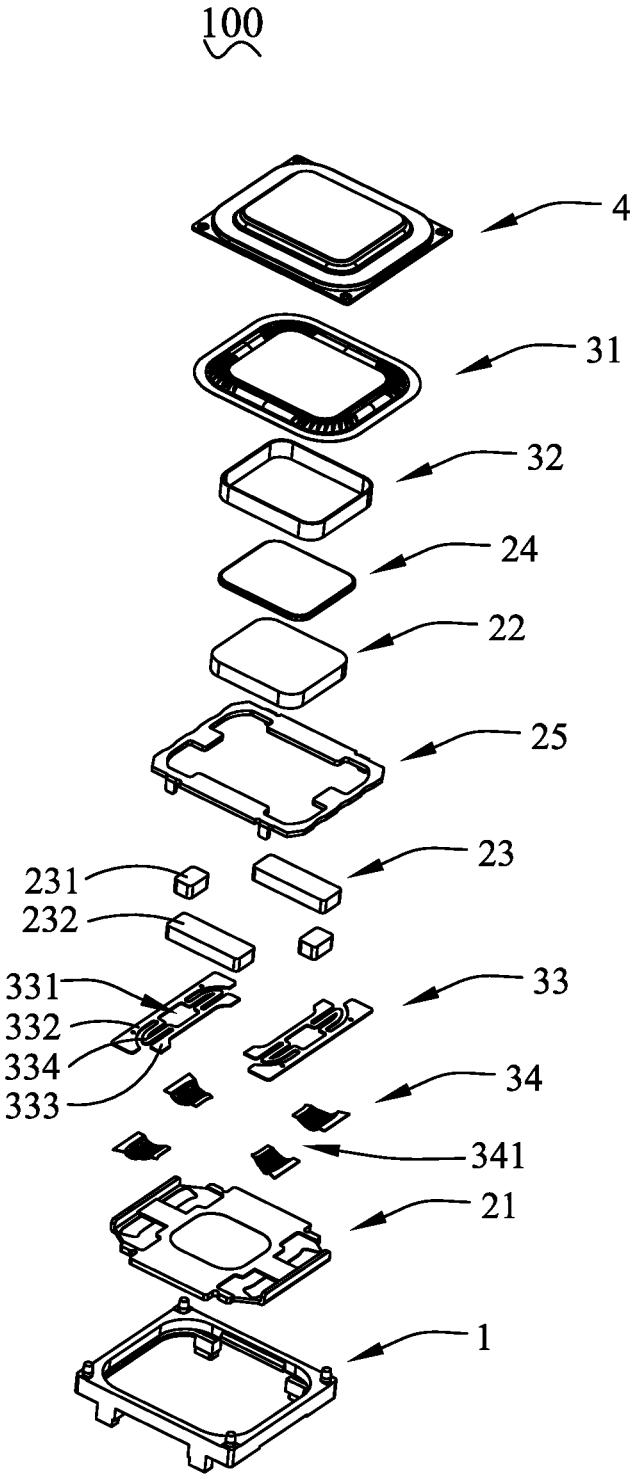
FIG. 1 is an isometric and exploded view of a speaker according to the present invention.
Figure 2:
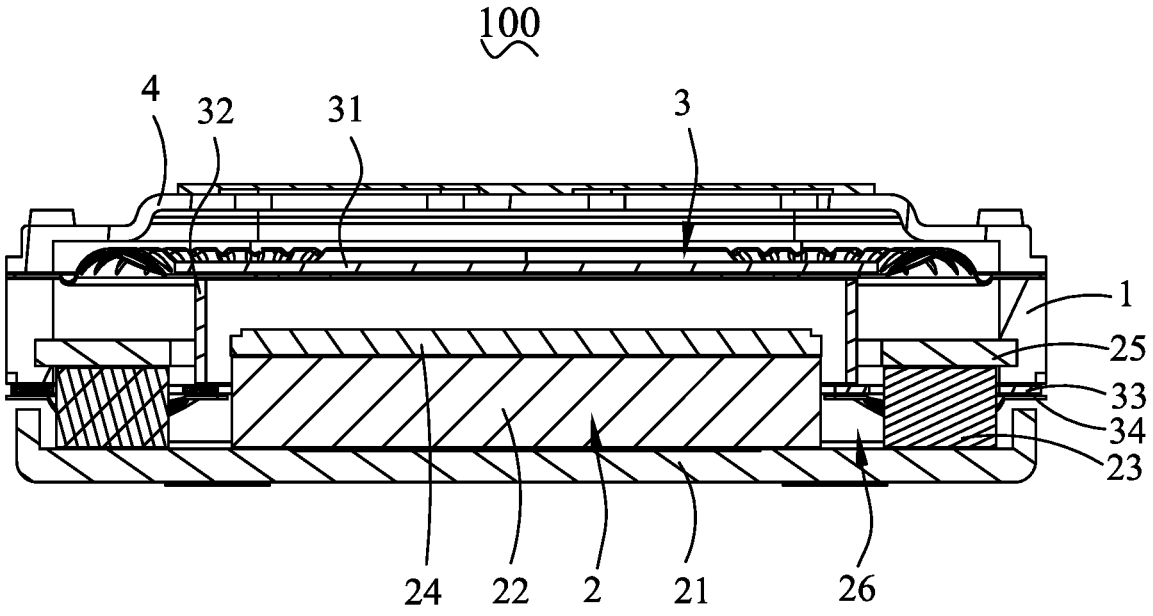
FIG. 2 is a cross-sectional view of the speaker according to the present invention.

Referring to FIG. 1 and FIG. 2, the present invention discloses a speaker 100 which includes a frame 1, a magnetic circuit system 2, a vibrating system 3 and a front cover 4. The front cover 4 is covered on the frame 1 to form a receiving space, both the magnetic circuit system 2 and the vibrating system 3 are accommodated within the receiving space of the frame 1. The magnetic circuit system 2 is used for generating a constant magnetic field, and the vibrating system 3 will generate a vibration in the constant magnetic field to produce sound after being provided with an electronic signal.

The magnetic circuit system 2 includes a yoke 21, a main magnet 22, an auxiliary magnet 23, a main pole core 24, and an auxiliary pole core 25. Both the main magnet 22 and the auxiliary magnet 23 are arranged on the yoke 21, and the auxiliary magnet 23 surrounds the main magnet 22. The main pole core 24 and the auxiliary pole core 25 are attached to the main magnet 22 and the auxiliary magnet 23 respectively. The main magnet 22 is spaced from the auxiliary magnetic 23, and a gap between the main magnet 22 and the auxiliary magnet 23 is a magnetic gap 26.

The vibrating system 3 sandwiched between the front cover 4 and the frame 1 comprises a vibrating diaphragm 31, a voice coil 32, and a suspension 33. One end of the voice coil 32 is connected to the vibrating diaphragm 31, the other end of the voice coil 32 is suspended within the magnetic gap 26, and the voice coil 32 drives the vibrating diaphragm 31 to vibrate along a vibrating direction for producing sound.

The suspension 33 is two-piece type and is arranged on the two ends in a longitudinal direction of the main magnet 22. As shown in FIG. 2, the suspension 33 is located between the auxiliary pole core 25 and the yoke 21 along the vibrating direction of the vibrating diaphragm 31. One end of the suspension 33 is fixed on the frame 1, and the other end is fixed on the voice coil 32 at an end of away from the vibrating diaphragm 31. The auxiliary magnet 23 includes a first auxiliary magnet 231 arranged in the lateral direction of the main magnet 22, and a second auxiliary magnet 232 arranged in the longitudinal direction of the main magnet 22. The lateral direction of the main magnet 22 is perpendicular to the longitudinal direction of the main magnet 22. An orthographic projection of the suspension 33 on the yoke 21 along the vibrating direction of the vibrating diaphragm 31, and an orthographic projection of the first auxiliary magnet 231 on the yoke 21 along the vibrating direction of the vibrating diaphragm 31 at least do not partially overlap, and preferably do not overlap at all. A first avoiding space 331 is provided at a position of the suspension 33 corresponding to the first auxiliary magnet 231. The first auxiliary magnet 231 passes through the first avoiding space 331 and is fixed to the auxiliary pole core 25.

The suspension 33 includes a first fixing portion 333 fixed on the voice coil 32, a second fixing portion 332 fixed on the frame 1, and an elastic portion 334 connected the first fixing portion 333 with the second fixing portion 332. The first avoiding space 331 is arranged between the first fixing portion 333 and the second fixing portion 332.

The vibrating system 3 further includes an auxiliary vibrating diaphragm 34 fixedly connected to the suspension 33. The auxiliary vibrating diaphragm 34 is concaved along the vibrating direction of the vibrating diaphragm 31 away from the suspension 33. The auxiliary vibrating diaphragm 34 has a through-hole 341 corresponding to the first auxiliary magnet 231. The first auxiliary magnet 231 passes through the first avoiding space 331 via the through-hole 341. The auxiliary vibrating diaphragm 34 is two-piece type and is fixed on the corresponding suspension 33. In the specific embodiment of the present invention, the auxiliary vibrating diaphragm 34 is divided into two-piece type by the through-hole 341.

The first avoiding space 331 and the through-hole 341 are arranged corresponding to each other, and both are avoided for installing the first auxiliary magnet 231.

The present invention has advantages that: in the speaker of the present invention, the suspension is provided with a first avoiding space so that the first auxiliary magnet can be arranged surrounding the main magnet, thereby enhancing the strength of the magnetic field, and ensuring even force applied on the vibrating diaphragm to improve BLX symmetry of the vibrating diaphragm.

The above description is only a preferred embodiment of the present invention, and it should be noted that those skilled in the art can also make improvements without departing from the inventive concept of the present invention, but these improvements all belong to the protection scope of the invention.

What is claimed is:

1. A speaker, comprising a frame, a magnetic circuit system and a vibrating system, where in, both the magnetic circuit system and the vibrating system are accommodated within the frame, the magnetic circuit system including a yoke, a main magnet, an auxiliary magnet, a main pole core and an auxiliary pole core, where in, the main magnet and the auxiliary magnet are both arranged on the yoke, the auxiliary magnet surrounds the main magnet, the main pole core and the auxiliary pole core are attached to the main magnet and the auxiliary magnet respectively, the main magnet is spaced apart from the auxiliary magnet and a magnetic gap is formed between the main magnet and the auxiliary magnet;

the vibrating system comprising a vibrating diaphragm, a voice coil for driving the vibrating diaphragm for vibrating along a vibrating direction, and a suspension, wherein, one end of the voice coil is connected to the vibrating diaphragm, the other end of the voice coil is suspended within the magnetic gap; and the suspension is located between the yoke and the auxiliary pole core;

the auxiliary magnet including a first auxiliary magnet provided on the two opposite sides of the main magnet, where in, an orthographic projection of the suspension on the yoke along the vibrating direction of the vibrating diaphragm, and an orthographic projection of the first auxiliary magnet on the yoke along the vibrating direction of the vibrating diaphragm at least do not partially overlap;

the auxiliary magnet further including a second auxiliary magnet provided on the two opposite sides of the main magnet and directly corresponding to the suspension, where in, the suspension has a first avoiding space corresponding to the first auxiliary magnet, and the first auxiliary magnet passes through the first avoiding space and is fixed to the auxiliary pole core.

2. The speaker according to claim 1, wherein the suspension includes a first fixing portion fixed on the voice coil, a second fixing portion fixed on the frame, and an elastic portion connected the first fixing portion with the second fixing portion; and the first avoiding space is arranged between the first fixing portion and the second fixing portion.

3. The speaker according to claim 1, wherein the vibrating system further comprises an auxiliary vibrating diaphragm fixedly connected to the suspension, the auxiliary vibrating diaphragm concaved along the vibrating direction of the vibrating diaphragm away from the suspension has a through-hole corresponding to the first auxiliary magnet, and the first auxiliary magnet passes through the first avoiding space via the through-hole.

4. The speaker according to claim 2, wherein the vibrating system further comprises an auxiliary vibrating diaphragm fixedly connected to the suspension, the auxiliary vibrating diaphragm concaved along the vibrating direction of the vibrating diaphragm away from the suspension has a through-hole corresponding to the first auxiliary magnet, and the first auxiliary magnet passes through the first avoiding space via the through-hole.

5. The speaker according to claim 3, wherein the auxiliary vibrating diaphragm is two-piece type and is fixed on the corresponding suspension.

6. The speaker according to claim 3, wherein the auxiliary vibrating diaphragm is divided into two-piece type by the through-hole.

7. The speaker according to claim 1, where in the speaker further comprises a front cover covered on a side of the frame near the vibrating diaphragm, the vibrating diaphragm is sandwiched between the front cover and the frame.

* * * * *